US006818609B2

(12) United States Patent
Blithe et al.

(10) Patent No.: US 6,818,609 B2
(45) Date of Patent: Nov. 16, 2004

(54) METAL DEFORMATION COMPOSITIONS AND USES THEREOF

(75) Inventors: Robert L. Blithe, Lansdowne, PA (US); Joseph F. Warchol, Norristown, PA (US); James F. Haus, Conshohocken, PA (US)

(73) Assignee: Houghton Technical Corp., Wilmington, DE (US)

( * ) Notice: Subject to any disclaimer, the term of this patent is extended or adjusted under 35 U.S.C. 154(b) by 283 days.

(21) Appl. No.: 10/224,854

(22) Filed: Aug. 21, 2002

(65) Prior Publication Data

US 2004/0038846 A1 Feb. 26, 2004

(51) Int. Cl.[7] ..... C11D 3/386; C11D 3/30

(52) U.S. Cl. ..... 510/365; 510/242; 510/417; 510/421; 510/433; 510/499; 510/505; 134/40

(58) Field of Search ..... 510/365, 242, 510/417, 421, 433, 499, 505; 134/40

(56) References Cited

U.S. PATENT DOCUMENTS

| | | | | |
|---|---|---|---|---|
| 4,105,573 A | * | 8/1978 | Jacobsen | 510/222 |
| 4,246,103 A | * | 1/1981 | Block et al. | 210/699 |
| 5,080,822 A | * | 1/1992 | VanEenam | 510/365 |
| 5,688,750 A | | 11/1997 | Cooban | |
| 5,707,945 A | | 1/1998 | Cooban | |
| 5,998,358 A | * | 12/1999 | Herdt et al. | 510/506 |
| 6,060,438 A | | 5/2000 | Oleksiak | |
| 6,100,227 A | * | 8/2000 | Burlew | 510/245 |

FOREIGN PATENT DOCUMENTS

| | | |
|---|---|---|
| WO | WO94/28093 A1 | 12/1994 |
| WO | WO95/07961 A1 | 3/1995 |
| WO | WO01/59040 A1 | 8/2001 |

OTHER PUBLICATIONS

Jungermann and Silbermann, "Phosphorus–Containing Anionic Surfactants" in Anionic Surfactants Part II, pp. 518–524, Warner M. Linfield ed., New York, Marcel Dekker Inc. (1976).

S. Stinson, "Phosphites Add Across Double Bonds", Chemical & Engineering News, p. 45 (Sep., 2000).

C. Herranz, "Alkylphosphinic Surfactants with C14–C16 Fatty Chain", Journal of the American Oil Chemists' Society, 64(7):1038–1039 (Jul., 1987).

R. Sasin et al, "Phosphorus Derivatives of Fatty Acids. The Addition of Dialkyl Phosphonates to Unsaturated Acids and the Synthesis of Some 11–Dialkylphosphonoundecanoamides", Journal of the American Oil Chemists' Society, 42:134–136 (Feb., 1965).

* cited by examiner

*Primary Examiner*—Gregory Webb
(74) *Attorney, Agent, or Firm*—Howson and Howson

(57) ABSTRACT

The present invention provides metal deformation compositions and emulsions which contain a phosphonate ester. Lubricating esters, emulsifiers, dispersants, antioxidants, corrosion inhibitors, alkaline compounds, and solubilizing carriers, can be included in the compositions and emulsions. Methods for deforming metals are also provided.

96 Claims, 1 Drawing Sheet

METAL DEFORMATION COMPOSITIONS AND USES THEREOF

BACKGROUND OF THE INVENTION

This invention relates to the field of metal deformation and to compositions and emulsions used therefor. More specifically, the present invention relates to metal-deformation compositions and emulsions which contain a phosphonate ester.

A number of compositions and emulsions are used in metal deformation processes to provide a boundary layer which separates the process equipment from the metal slabs to be processed. Such compositions and emulsions also facilitate the transport of water insoluble materials contained therein to the process equipment or metal slabs in a uniform and consistent manner. They further provide cooling by evaporative water loss or by heat removal from the system through surface contact with the process equipment or the metal slabs.

The emulsions known in the art used for metal deformation processes contain fatty acids, which effectively provide good lubrication between the process equipment and metal slab. However, a number of problems are encountered when using the emulsions of the art. These problems include the formation of metallic soap particles via reactions between the fatty acids and the metal surfaces, dissolved multi-valent ions from the metal surfaces or water, or combinations thereof. These metallic soap particles are highly viscous and thereby alter the boundary lubrication between the process equipment and metal slabs. Therefore, in order to correct this deficiency, it is necessary to carry out a substantial or partial removal of the emulsions from the system and dispose of the same during the metal deformation process, which is both time and cost ineffective.

There exists a need in the art for metal deformation compositions and emulsions which retain beneficial lubrication properties, but do not generate metallic soap particles during the metal deformation process.

SUMMARY OF THE INVENTION

In one aspect, metal deformation compositions of this invention are provided which contain a phosphonate ester.

In another aspect, this invention provides metal deformation emulsions which contain a phosphonate ester and water.

In a further aspect, this invention provides methods of deforming metals which include applying the compositions of the invention to a metal and deforming the metal.

In yet another aspect, methods of deforming metals are provided which include applying the emulsions of the invention to a metal and deforming the metal.

In yet a further aspect, this invention provides methods of preparing reagents for use in metal deformation which include diluting the compositions of the invention with water.

Other aspects and advantages of the present invention are described further in the following detailed description of the preferred embodiments thereof.

DETAILED DESCRIPTION OF THE INVENTION

Figure 1:
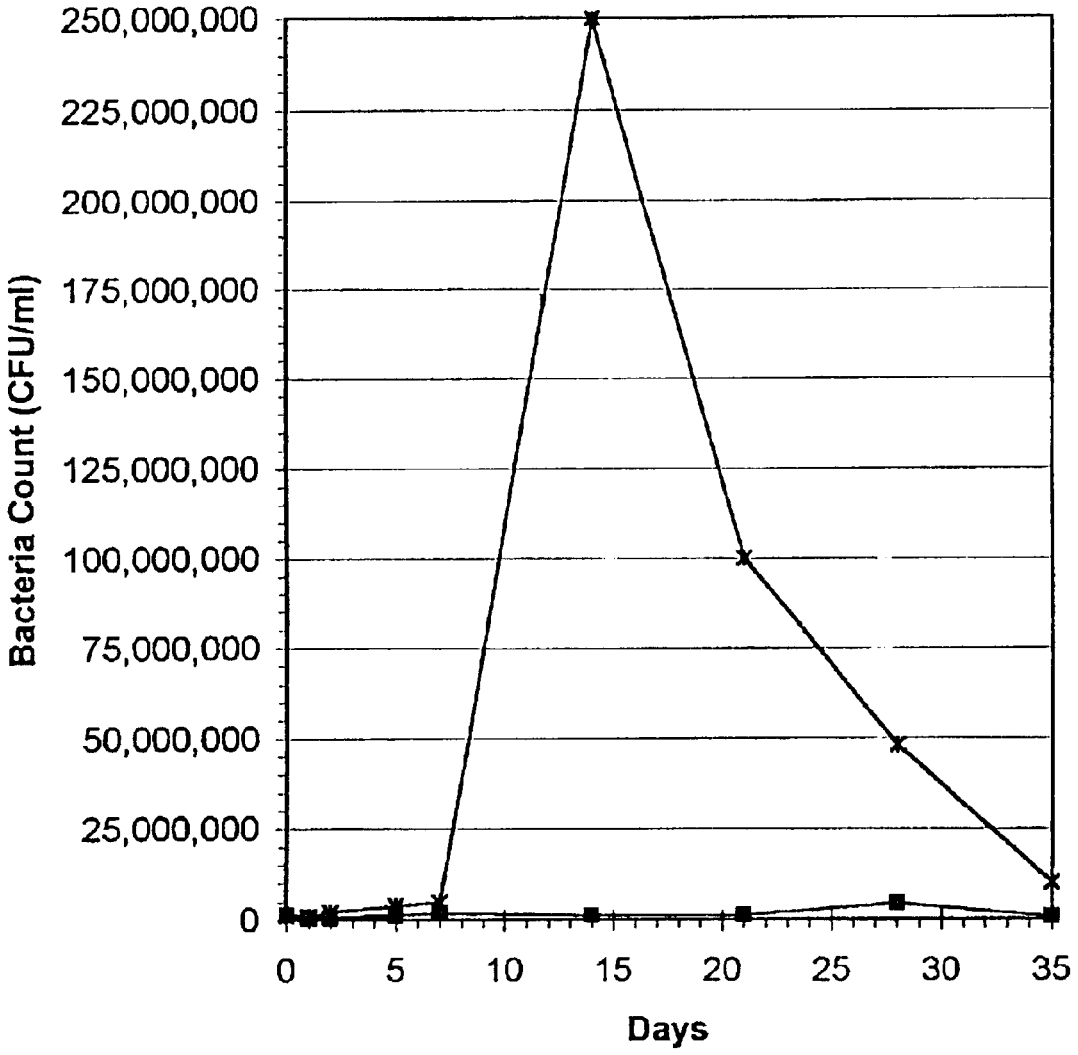
FIG. 1 is a graph illustrating the biostability of certain embodiments of the emulsions of the invention. Emulsion A is represented by (x) and Emulsion B is represented by shaded boxes (■).

The present invention provides compositions and emulsions for use in metal deformation processes. The compositions and emulsions discussed herein have the lubrication properties provided by fatty acids, but do not generate metallic soap particles during the metal deformation process. These compositions and emulsions also allow for a reduction in the frequency and amounts of lubricating material that is removed during metal deformation.

The phrase "metal deformation process" as used herein and throughout the specification is meant to describe processes that are performed on or to a metal to alter the state thereof. Preferably, the metal deformation processes of the present invention include those processes in which a metal surface or slab is deformed. Such processes can be performed at cold or hot temperatures and include metal rolling, drawing, and forming operations.

By the term "metal" as used herein and throughout the specification is meant to describe metals that can be processed using techniques known in the art and the methods and compositions of the present invention. Such "metals" include, for example, iron, aluminum, copper, magnesium, tin, and zinc. The term "metal" also includes alloys of the above-noted metals with other elements that produce a stable metal alloy. Preferably, the metal is an aluminum alloy. Typically, the metal to be processed is in the form of a slab, sheet, rod, or any other form that can be processed using the metal deformation processes defined above.

I. Metal Deformation Compositions

The present invention provides metal deformation compositions which contain a phosphonate ester, a lubricating ester, an emulsifier, a dispersant, or a combination thereof. These compositions can also include an antioxidant; a corrosion inhibitor; and an optional solubilizing carrier or an alkaline compound.

In certain embodiments, these metal deformation compositions of the present invention are substantially free of fatty acids. The phrase "substantially free of fatty acids" as used herein and throughout this specification is meant to describe a composition having less than about 1% by weight fatty acids. In one embodiment, the phrase "substantially free of fatty acids" describes a composition having about 0% to about 0.9% by weight fatty acids. In other embodiments, metal deformation compositions of the present invention contain varying small amounts of fatty acids, at least about 1% by weight and up to an amount that does not produce an undue amount of metallic soap particles during use. For example, rosin acids and hindered fatty acids, such as neo acids, do not react to form metallic soap particles.

A. The Phosphonate Ester

As described herein, the present invention provides metal deformation compositions which include one or more phosphonate ester. Without wishing to be bound by theory, the phosphonate ester is believed to assist in the formation of a boundary layer on both the process equipment and the metal slab to be deformed and withstands the high temperatures and pressures that are encountered in metal deformation processes. Preferably, the phosphonate ester is an alkyl alkylphosphonate ester.

As used herein, the phase "alkyl alkylphosphonate ester" is meant to describe a phosphorus compound of the formula:

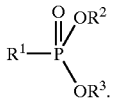

In the formula above, $R^1$ is $C_2$ to $C_{20}$ alkyl, substituted $C_2$ to $C_{20}$ alkyl, $C_2$ to $C_{20}$ alkenyl, substituted $C_2$ to $C_{20}$ alkenyl, $C_2$ to $C_{20}$ alkynyl, substituted $C_2$ to $C_{20}$ alkynyl, $C_6$ to $C_{20}$ aryl, or $C_6$ to $C_{20}$ alkyl aryl. $R^2$ and $R^3$ are independently H, $C_1$ to $C_8$ alkyl, substituted $C_1$ to $C_8$ alkyl, $C_2$ to $C_8$ alkenyl, substituted $C_2$ to $C_8$ alkenyl, $C_2$ to $C_8$ alkynyl, substituted $C_2$ to $C_8$ alkynyl, $C_6$ to $C_{20}$ aryl, or $C_6$ to $C_{20}$ alkyl aryl. Tautomers or acceptable salts thereof of the above-noted formula can also be utilized according to the present invention.

By the term "alkyl aryl" as used herein and throughout the specification is meant to describe an aryl group which is substituted with one or more alkyl groups and where the point of attachment of the "alkyl aryl" group is though the aryl group.

The $R^1$, $R^2$, and $R^3$ substituents noted above can be the same or can be different. In one embodiment, $R^1$ is $C_{14}$ to $C_{18}$ alkyl and $R^2$ and $R^3$ are defined as noted above. In another embodiment, $R^2$ is H or $C_1$ to $C_4$ alkyl and $R^1$ and $R^3$ are defined as noted above. In a further embodiment, $R^3$ is H or $C_1$ to $C_4$ alkyl and $R^1$ and $R^2$ are defined as noted above. In yet another embodiment, $R^2$ and $R^3$ are the same and are hydrogen, methyl, ethyl, or butyl groups.

The compositions of the present invention typically contain about 0.5% to about 12% by weight of a phosphonate ester. Preferably, the compositions contain about 2% to about 6% by weight of a phosphonate ester. More preferably, the compositions contain about 3% by weight of a phosphonate ester.

B. Lubricating Ester

To provide lubrication to the surface of the metal being deformed, as well as the process equipment, one or more of a lubricating agent, typically one or more of a lubricating ester, is included as a second component in the compositions of the present invention. A variety of lubricating esters known in the art can be utilized in the present invention and include, without limitation, polyol esters, trimer acid esters, or dimer acid esters. Suitable lubricating esters are commercially available from a number of manufacturers.

In one embodiment, the lubricating ester is a polyol ester. Preferably, the lubricating ester is a polyol ester which results from the reaction of a $C_7$ to $C_{20}$ fatty acid with a polyol alcohol. Polyol alcohols that can be utilized to form the polyol esters used in the present invention include, without limitation, pentaerythritol, trimethylolpropane, trimethyolethane, neopentylglycol, or neopentylglycol monohydroxy pivalate.

In another embodiment, the lubricating ester is a trimer or dimer acid ester of one or more of a monohydric alcohol. Preferably, the lubricating ester is trimer or dimer acid ester of a methoxy polyethylene glycol monohydric alcohol having an average molecular weight of about 350, a trimer or dimer acid ester of a methoxy polyethylene glycol monohydric alcohol having an average molecular weight of about 350 and a $C_1$ to $C_9$ aliphatic monohydric alcohol, a trimer or dimer acid ester of a $C_1$ to $C_9$ aliphatic monohydric alcohol, or combinations thereof.

In certain compositions of this invention, the trimer acid ester is the product resulting from the esterification of a polymerized unsaturated $C_{12}$ to $C_{24}$ fatty acid with one or more of a monohydric alkoxylated alcohol. The monohydric alkoxylated alcohol can be, without limitation, a $C_1$ to $C_{24}$ aliphatic saturated alcohol alkoxylated with about 2 to about 25 moles of a $C_2$ to $C_5$ alkylene oxide, a $C_1$ to $C_4$ terminated alkoxy polyalkylene glycol alkoxylated with about 2 to about 25 moles of a $C_2$ to $C_5$ alkylene oxide, or a combination thereof. In other compositions of the invention, the trimer acid ester is formed from the esterification of a polymerized unsaturated $C_{12}$ to $C_{24}$ fatty acid with one or more of a monohydric alkoxylated alcohol as described above, and an aliphatic $C_1$ to $C_{24}$ monohydric alcohol.

In yet another embodiment, combinations of the above-noted lubricating esters can be utilized in the compositions of this invention.

The compositions of the invention preferably contain about 4% to about 50% by weight of a lubricating ester or esters. More preferably, the compositions contain about 24% by weight of a lubricating ester or esters.

C. Emulsifier or Dispersant

An agent which provides stability to an emulsion or dispersion is also included in the compositions of the present invention. Preferably, the agent is an emulsifier or dispersant. In one embodiment, one or more of an emulsifier or dispersant is included in the compositions of the invention. In another embodiment, one or more of an emulsifier and one or more of a dispersant is included in the compositions of the invention.

A number of emulsifiers and dispersants are known in the art and are commercially available from numerous manufacturers. Such emulsifiers and dispersants include, without limitation, alkoxylated linear alcohols, alkoxylated secondary alcohols, alkoxylated alkylaryl alcohols, alkoxylated primary amines, alkoxylated amides, alkoxylated phosphate esters, alkoxylated acids, and sodium petroleum sulfonates, among others. Preferably, the emulsifier is an alkoxylated primary amine or sodium petroleum sulfonate.

Preferably, the compositions contain about 0.5% to about 15% by weight of an emulsifier, dispersant, or combination thereof. More preferably, the compositions contain about 0.5% to about 6% by weight of an emulsifier, dispersant, or combination thereof.

D. Antioxidant

The compositions of the invention can include as a further component one or more of an antioxidant which either retards or inhibits the oxidative deterioration of the compositions of the invention.

A variety of suitable antioxidants are known in the art and are commercially available from numerous manufacturers. Such antioxidants include, without limitation, butylated hydroxytoluene, butylated hydroxyanisole, phosphites, phenolic antioxidants, and amine antioxidants, among others. In one embodiment, the amine antioxidant is alkylated diphenylamine. Preferably, the antioxidant is butylated hydroxytoluene, butylated hydroxyanisole, or phosphites. More preferably, the antioxidant is butylated hydroxytoluene.

Preferably, the composition contains about 0.1% to about 1% by weight of an antioxidant. More preferably, the composition contains about 0.4% by weight of an antioxidant E. Corrosion Inhibitor One or more of a corrosion inhibitor, which prevents the corrosion of the process or press equipment, is optionally included as another component of the compositions of the invention.

A number of corrosion inhibitors are known in the art and are commercially available from numerous manufacturers. Such corrosion inhibitors include benzotriazole, tolyltriazole, and petroleum sulfonates. Preferably, the corrosion inhibitor is tolyltriazole or petroleum sulfonates.

Preferably, the compositions contain about 0.1% to about 5% by weight of a corrosion inhibitor. More preferably, a composition of this invention contains about 1% by weight of a corrosion inhibitor F. Carrier The compositions of the invention optionally include a solubilizing carrier which solubilizes one or more components of the compositions. In one embodiment, the carrier is a reagent which does not react with the components of the compositions. In another embodiment, the carrier has a viscosity of about 50 to about 3000 Saybolt Universal Seconds at 100° F.

A variety of carriers are known in the art and are commercially available from numerous manufacturers. Such carriers can be used in the compositions of the present invention and include hydrocarbon oils, esters, and lubricating esters, among others. The hydrocarbon oil can be a mineral oil, naphthenic hydrocarbon oil, paraffinic hydrocarbon oil, poly α-olefin, alkylbenzene, polyisobutylene, and polypropylene.

Preferably, the compositions contain at least 50% by weight of a solubilizing carrier. More preferably, a composition of this invention contains about 50% to about 85% by weight of a carrier.

G. Alkaline Compound

The compositions of the present invention optionally include one or more of an alkaline compound. By the phrase "alkaline compound" is meant any chemical compound that when used in the composition of the present invention maintains a pH of about 6.0 to about 6.5. The alkaline compound can also provide biostability to the compositions of the invention.

A number of alkaline compounds are known in the art and are commercially available from numerous manufacturers. Such alkaline compounds include, without limitation, alkanolamines, alkali hydroxides, alkylamines, and N-alkylalkanol amines, among others. In one embodiment, the alkanolamine is monoethanolamine, triethanolamine, aminomethyl propanol, monoisopropanol amine, triisopropanol amine, or diglycolamine. In another embodiment, the hydroxide reagent is sodium hydroxide or potassium hydroxide. In a further embodiment, the alkylamine is $C_{12}$ to $C_{14}$ t-alkylamine.

Preferably, a composition of the invention contains about 0.1% to about 5% by weight of the alkaline compound.

H. Other Reagents

Other optional reagents which do not affect the properties of, or react with, the above-listed components of the metal deformation compositions of the invention can be added thereto. Such optional reagents include surfactants, coupling agents, anti-wear additives, thickening or bodying agents, antifoam agents, detergents, pour point depressors, viscosity index improvers, coloring agents, fungicides, biostability agents, anti-rust agents, and combinations thereof. See, Mortier et al., "Chemistry and Technology of Lubricants", VCH Publisher, Inc., 1992, which is hereby incorporated by reference.

I. Examples of Metal Deformation Compositions of the Invention

In one embodiment, a metal deformation composition is provided which contains about 0.5% to about 12% by weight of a phosphonate ester; about 4% to about 50% by weight of a lubricating ester; about 0.5% to about 15% by weight of an emulsifier, dispersant, or combination thereof, about 0.1% to about 1% by weight of an antioxidant; and about 0.1% to about 5% by weight of a corrosion inhibitor.

In another embodiment, a metal deformation composition is provided which is substantially free of fatty acids and contains about 0.5% to about 12% by weight of a phosphonate ester; about 4% to about 50% by weight of a lubricating ester; about 0.5% to about 15% by weight of an emulsifier, dispersant, or combination thereof; about 0.1% to about 1% by weight of an antioxidant; and about 0.1% to about 5% by weight of a corrosion inhibitor.

In a further embodiment, a metal deformation composition is provided which is substantially free of fatty acids and contains about 0.5% to about 12% by weight of a phosphonate ester; about 4% to about 50% by weight of a lubricating ester; about 0.5% to about 15% by weight of an emulsifier, dispersant, or combination thereof; about 0.1% to about 1% by weight of an antioxidant; about 0.1% to about 5% by weight of a corrosion inhibitor; and at least 50% by weight of a solubilizing carrier.

In yet another embodiment, a metal deformation composition is provided which contains about 1% to about 10% by weight of a phosphonate ester; about 4% to about 50% by weight of a lubricating ester; about 1% to about 15% by weight of an emulsifier, dispersant, or combination thereof; about 0.1% to about 5% by weight of an alkaline compound; and about 50% to about 85% by weight of a solubilizing carrier.

In a further embodiment, a metal deformation composition is provided which contains about 0.5% to about 12% by weight of a phosphonate ester; about 4% to about 80% by weight of a lubricating ester; about 0.5% to about 15% by weight of an emulsifier, dispersant, or combination thereof; about 0.1% to about 1% by weight of an antioxidant; about 0.1% to about 5% by weight of a corrosion inhibitor; and at least 50% by weight of a solubilizing carrier.

In another embodiment, a metal deformation composition is provided which contains about 1% to about 10% by weight of a phosphonate ester; about 4% to about 25% by weight of a trimer acid ester of a methoxypolyethylene glycol monohydric alcohol having an average molecular weight of about 350, a $C_1$ to $C_9$ aliphatic monohydric alcohol, or combinations thereof; about 1% to about 15% by weight of an emulsifier, dispersant, or combination thereof; about 0.1% to about 5% by weight of an alkaline compound; about 0.1% to about 1% by weight of an antioxidant; about 0.1% to about 5% by weight of a corrosion inhibitor; and about 50% to about 85% by weight of a hydrocarbon oil.

In yet a further embodiment, a metal deformation composition is provided which contains about 1% to about 10% by weight of a phosphonate ester; about 4% to about 25% by weight of a trimer acid ester of a methoxypolyethylene glycol monohydric alcohol having an average molecular weight of about 350, a $C_1$ to $C_9$ aliphatic monohydric alcohol, or combinations thereof; about 1% to about 15% by weight of an emulsifier, dispersant, or combination thereof; about 4% to about 20% by weight of a polyol ester of a $C_7$ to $C_{20}$ fatty acid; about 0.1% to about 1% by weight of of an antioxidant; about 0.1% to about 5% by weight of a corrosion inhibitor; about 0.1% to about 5% by weight of an alkaline compound; and about 50% to about 85% by weight of a hydrocarbon oil.

In a preferred embodiment, the specific examples of metal-deformation compositions of the present invention noted above are substantially free of fatty acids.

II. Metal Deformation Emulsions

The present invention also provides metal deformation emulsions which have desirable lubricating properties, but do not generate metallic soap particles during the metal deformation process. Preferably, oil-in-water emulsions can be prepared according to the present invention.

By the term "emulsion" as used herein and throughout the specification is meant to describe a solution containing a heterogeneous mixture of two or more immiscible liquids in which one liquid forms minute droplets which are suspended in the other liquid(s). In one embodiment, a macroemulsion can be formed in which the size of the minute droplets is about 5,000 (0.5$\mu$) Å to about 100,000 Å (10$\mu$). Preferably, the size of the droplets in the macroemulsion is about 10,000 (1$\mu$) Å to about 40,000 Å (4$\mu$).

The phrase "oil-in-water emulsion" as used herein and throughout the specification is meant to describe an emulsion having oil soluble and aqueous soluble components. The phrase "oil-in-water emulsion" can also describe an emulsion having an oil phase and a water phase, in which the oil and water phases are thoroughly combined to form one oil-in-water phase. Preferably, the oil-in-water emulsions of the invention include about 1% to about 20% by weight of oil phase and about 80% to about 99% by weight of an aqueous phase. More preferably, the oil-in-water emulsions include about 2% to about 10% by weight of an oil phase.

The oil-in water emulsions of the invention can be prepared by combining water, a phosphonate ester, and a solubilizing carrier. One or more of a lubricating ester, emulsifier, dispersant, antioxidant, corrosion inhibitor, or alkaline compound, among others can be added to the oil-in-water emulsions Preferably, the oil-in-water emulsions are prepared by diluting the above described compositions of the invention with water and a solubilizing carrier. For example, embodiments of emulsions of the invention include, without limitation, the following.

In one embodiment, an oil-in-water emulsion is provided including about 1% to about 20% by weight of an oil phase which contains about 0.5% to about 12% by weight of a phosphonate ester and at least 50% by weight of a solubilizing carrier; and about 80% to about 99% by weight water.

In another embodiment, an oil-in-water emulsion is provided including about 1% to about 20% by weight of an oil phase which contains about 1% to about 10% by weight of a phosphonate ester; about 1% to about 15% by weight of an emulsifier, dispersant, or combination thereof; about 4% to about 50% by weight of a lubricating ester; about 50% to about 85% by weight of a carrier; and about 0.1% to about 5% by weight of an alkaline compound; and an aqueous phase containing about 80% to about 99% by weight water.

In a further embodiment, an oil-in-water emulsion is provided including about 1% to about 20% by weight of an oil phase, which contains about 1 to about 10% by weight of a phosphonate ester; about 4 to about 25% by weight of a trimer acid ester of a methoxypolyethylene glycol monohydric alcohol having an average molecular weight of about 350, a $C_1$ to $C_9$ aliphatic monohydric alcohol, or combination thereof; about 1% to about 15% by weight of an emulsifier, dispersant, or combination thereof; about 0.1% to about 1% by weight of an antioxidant; about 0.1% to about 5% by weight of a corrosion inhibitor; about 50% to about 85% by weight of a hydrocarbon oil; and about 0.1% to about 5% by weight of an alkaline compound; and an aqueous phase containing about 80% to about 99% by weight water.

In yet another embodiment, an oil-in-water emulsion is provided including about 1% to about 20% by weight of an oil phase which contains about 1% to about 10% by weight of a phosphonate ester; about 4% to about 25% by weight of a trimer acid ester of a methoxypolyethylene glycol monohydric alcohol having an average molecular weight of about 350, a $C_1$ to $C_9$ aliphatic monohydric alcohol, or combination thereof; about 4% to about 20% by weight of a polyol ester of a $C_7$ to $C_{20}$ fatty acid; about 1% to about 15% by weight of an emulsifier, dispersant, or combination thereof; about 0.1% to about 5% by weight of a corrosion inhibitor; about 0.1% to about 1% by weight of an antioxidant; about 50% to about 85% by weight of a hydrocarbon oil; and about 0.1% to about 5% by weight of an alkaline compound; and an aqueous phase containing about 80% to about 99% by weight water.

In a preferred embodiment, the specific examples of emulsions of the present invention noted above are substantially free of fatty acids.

III. Methods of Deforming Metals

The compositions and emulsions of the present invention can be utilized in metal deformation processes. By the term "metal deformation process" as used herein and throughout the specification is meant to describe any metal process known in the art which deforms or alters the state of a metal. Such processes can include cold or hot metal rolling, drawing, and forming, among others.

A number of types of process or press equipment known in the art can be utilized to deform metals and can be selected by those skilled in the art with regard to the metal being deformed and the product to be prepared therefrom.

A number of metals can be processed using the deformation processes and compositions and emulsions of the present invention and include, among others, iron, aluminum, copper, magnesium, tin, zinc, and alloys thereof. Preferably, the metal is an aluminum alloy. Typically, the metal to be deformed is in the form of a slab, sheet, or rod.

The compositions and/or emulsions of the invention can be applied to the process equipment and/or metal slab using techniques known by those of skill in the art and include spraying, coating, and brushing. Typically, the compositions or emulsions are applied such that a thin layer of the composition or emulsion is present on the surface. The amount of composition or emulsion applied to the process equipment or metal slab can be increased or decreased as determined by one skilled in the art. A number of factors can influence the amount of composition or emulsion applied to the metal slab or process equipment and include temperature, pressure, property of the metal, type of process, and property of the desired deformed metal, among others.

In one embodiment, the compositions or emulsions are applied to both the process equipment and metal slab to be deformed. In another embodiment, the compositions or emulsions can be applied to only the metal slab or process equipment as determined by one skilled in the art.

In one embodiment, a method of deforming a metal is provided which includes applying to the metal or equipment a composition according to the present invention and deforming the metal.

In another embodiment, a method of deforming a metal is provided which includes applying to the metal or equipment an emulsion according to the present invention and deforming the metal.

In yet another embodiment, a method of deforming a metal is provided which includes applying to the metal or process equipment, a composition according to the present invention and deforming the metal.

In a further embodiment, a method of deforming a metal is provided which includes applying to the metal or process equipment, an emulsion according to the present invention and deforming the metal.

The following examples illustrate the invention and do not limit the scope thereof. One of skill in the art will appreciate that although specific reagents and conditions are outlined in the following examples, modifications as described above can be made to provide the compositions of this invention or processes for use thereof.

EXAMPLES

Example 1

This example illustrates the ability of the emulsions of the present invention to provide good lubricating properties to the process equipment and metal slab during metal deformation processes.

A. The Metal Deformation Process

Data was obtained using a mini test rolling mill which was operated in two high, reversing, fixed gap modes using 500 mm nominal diameter deforming tools. The mini test mill closely parallels the mills currently utilized in factories to roll metals. The initial roughness on the surface of the rolls of the metal deforming tool was approximately 1.0 $\mu$m.

Three types of aluminum alloy slabs were processed using the mini rolling mill: a 1xxx series alloy, a 3xxx series alloy, and a 5xxx series alloy. The aluminum alloy metals used in this example are representative of metals processed in the art. Prior to rolling, the approximate initial metal alloy slab dimensions were 30 mm thick, 250 mm wide, and 1500 mm long. The metal alloy slabs were pre-heated to approximately 450° C. immediately prior to commencing with the rolling test.

Three emulsions were utilized to demonstrate the effectiveness of the emulsions of the invention. Emulsion 1 is the Tandemol® F282-B (Houghton International, Inc.—Valley Forge, Pa.) emulsion, which is a fatty acid containing emulsion of the prior art that is currently utilized in hot rolling metal deforming processes. Such emulsions eventually form metallic soap particles on the metal deforming tool.

Emulsions 2 and 3 were prepared according to the invention by mixing the compositions of the invention with water within an induced shear environment at 60° C. until the emulsions were uniform and consistent. The following Table 1 illustrates the composition of the oil phases of Emulsions 2 and 3 prepared according to the present invention.

TABLE 1

| Component | Emulsion 2 weight % | Emulsion 3 weight % |
|---|---|---|
| alkyl alkylphosphonate ester (Sylfat ® K - Arizona Chemical, Panama City, Florida) | 2 | 6 |
| trimer acid ester (Priolube ® 3952 - Uniqema, Wilmington, Delaware) | 13.8 | 13.8 |
| pentaerythritol tetraoleate polyol ester* | 10 | 10 |
| ethoxylated tallowamine and sodium petroleum sulfate emulsifiers* | 3.06 | 3.17 |
| aminomethylpropanol (Angus-Dow, Buffalo Grove, Illinois) | 0.26 | 1.16 |
| butylated hydroxytoluene* | 0.4 | 0.4 |
| tolyltriazole* | 0.3 | 0.3 |
| hydrocarbon oil* | 70.18 | 65.17 |

*available from a variety of commercial sources

The compositions set forth in Table 1 were then mixed with sufficient water to form emulsions having about 92% to about 95% by weight water.

The rolls of the mini test mill were pre-heated by circulating the hot emulsions which were maintained at a temperature of 60° C. through the test mill spray system. Three slabs of the 1xxx series aluminum alloy were rolled, followed by five slabs of the 3xxx series aluminum alloy, and finally five slabs of the 5xxx series aluminum alloy. The surfaces of the mini test mill were cleaned via brushing between each alloy type rolled.

All metal slabs were rolled at 50 meters per minute (mpm) with the exception of the last pass of the fifth slab of the 3xxx series aluminum alloy and the last pass of the fifth slab of the 5xxx series aluminum alloy which were processed at 100 mpm.

The distance between the scribe marks on the surface of the rolls, which are imprinted on the metal surface during the hot rolling process, was used to calculate the forward slip for each pass. The metal thickness or gauge was also measured on each pass for every slab processed.

A visual rating system of 1 to 3 was used to grade the anodized quality of each rolled metal alloy slab processed on the test mill. The center of each metal strip was graded separately from the edges of the strip. A rating of 1.0 indicates that the metal surface is of excellent quality, while a rating of 3.0 indicates that the metal surface is of poor quality.

Further, the load, coefficient of friction (COF), and reduction value was determined for each metal alloy slab.

B. Results

The data obtained using the above-noted emulsions on alloys 1xxx, 3xxx, and 5xxx can be found in Tables 2, 3, and 4 respectively. Specifically, data was obtained and compared for the last three passes for each alloy type.

TABLE 2

| 1xxx Series Alloy | Emulsion 1 | Emulsion 2 | Emulsion 3 |
|---|---|---|---|
| concentration | 8% | 8% | 8% |
| pass 3 | | | |
| reduction | 36.40% | 36.49% | 36.49% |
| forward slip | 7.33% | 6.71% | 6.46% |
| load | 66.2 | 60.0 | 59.7 |
| torque | 0.13 | 0.12 | 0.12 |
| C.O.F. | 0.348 | 0.325 | 0.323 |
| speed | 50 | 50 | 50 |
| pass 4 | | | |
| reduction | 54.89% | 54.36% | 54.64% |
| forward slip | 13.27% | 12.64% | 11.08% |
| load | 139.0 | 125.3 | 124.6 |
| torque | 0.22 | 0.20 | 0.20 |
| C.O.F. | 0.283 | 0.282 | 0.260 |
| speed | 50 | 50 | 50 |
| pass 5 | | | |
| reduction | 59.24% | 58.72% | 59.44% |
| forward slip | 19.27% | 17.27% | 17.02% |
| load | 213.1 | 195.9 | 197.7 |
| torque | 0.23 | 0.21 | 0.21 |
| C.O.F. | 0.240 | 0.222 | 0.216 |
| speed | 50 | 50 | 50 |
| anodized quality for center | 1.0 | 1.0 | 1.0 |
| anodized quality for edge | 1.75 | 1.0 | 1.0 |

TABLE 3

| 3xxx Series Alloy | Emulsion 1 | Emulsion 2 | Emulsion 3 |
|---|---|---|---|
| concentration | 8% | 8% | 8% |
| pass 3 | | | |
| reduction | 39.75% | 39.58% | 39.58% |
| forward slip | 9.2 1% | 8.96% | 8.64% |
| load | 188.3 | 182.5 | 174.6 |
| torque | 0.31 | 0.31 | 0.31 |
| C.O.F. | 0.353 | 0.349 | 0.332 |

TABLE 3-continued

| | 3xxx Series Alloy | | |
|---|---|---|---|
| | Emulsion 1 | Emulsion 2 | Emulsion 3 |
| speed | 50 | 50 | 50 |
| pass 4 | | | |
| reduction | 50.49% | 50.21% | 50.48% |
| forward slip | 13.46% | 12.96% | 12.14% |
| load | 246.9 | 240.8 | 235.9 |
| torque | 0.35 | 0.35 | 0.33 |
| C.O.F. | 0.284 | 0.285 | 0.273 |
| speed | 50 | 50 | 50 |
| pass 5 | | | |
| reduction | 53.58% | 51.39% | 52.92% |
| forward slip | 17.33% | 16.58% | 15.33% |
| load | 320.2 | 309.8 | 300.5 |
| torque | 0.35 | 0.36 | 0.32 |
| C.O.F. | 0.246 | 0.258 | 0.225 |
| speed | 100 | 100 | 100 |
| anodized quality for center | 1.0 | 1.0 | 1.0 |
| anodized quality for edge | 2.0 | 1.5 | 1.0 |

TABLE 4

| | 5xxx Series Alloy | | |
|---|---|---|---|
| | Emulsion 1 | Emulsion 2 | Emulsion 3 |
| concentration | 8% | 8% | 8% |
| pass 5 | | | |
| reduction | 45.11% | 45.52% | 45.47% |
| forward slip | 9.96% | 9.39% | 8.89% |
| load | 363.0 | 350.2 | 340.3 |
| torque | 0.55 | 0.53 | 0.54 |
| C.O.F. | 0.291 | 0.279 | 0.280 |
| speed | 50 | 50 | 50 |
| pass 6 | | | |
| reduction | 43.83% | 43.71% | 44.17% |
| forward slip | 9.14% | 8.46% | 7.96% |
| load | 308.4 | 289.5 | 268.4 |
| torque | 0.32 | 0.29 | 0.28 |
| C.O.F. | 0.216 | 0.200 | 0.176 |
| speed | 50 | 50 | 50 |
| pass 7 | | | |
| reduction | 42.70% | 42.34% | 41.56% |
| forward slip | 8.33% | 7.83% | 8.33% |
| load | 306.9 | 294.5 | 292.5 |
| torque | 0.24 | 0.24 | 0.24 |
| C.O.F. | 0.153 | 0.142 | 0.140 |
| speed | 100 | 100 | 100 |
| anodized quality for center | 1.75 | 1.25 | 1.25 |
| anodized quality for edge | 2.0 | 2.0 | 1.5 |

These data illustrate the effectiveness of Emulsions 2 and 3 of this invention in performing the hot rolling processes of different aluminum alloy types. Decreases in the forward slip, load, torque, and COF were generally observed for Emulsions 2 and 3 when compared to the commercial Emulsion 1. Further, reduction values for the 1xxx and 5xxx alloys were higher than those for Emulsion 1. These data demonstrate that Emulsions 2 and 3 of this invention provide lubrication properties that are more beneficial than Emulsion 1.

These data also illustrate that the lower roll load is important in manufacturing environments where the equipment is near the maximum stress load for the metal deformation process. Further, the lower COF values illustrate that less frictional contact occurs between the process equipment and the metal surface being deformed. The lower forward slip values also indicate an improvement of the lubrication properties within the metal deformation contact region with the rolls. The anodized quality ratings show lower values for Emulsions 2 and 3 which indicates a better surface finish to the deformed metal surface.

Example 2

This example illustrates the biostability of certain compositions of the present invention.

Two emulsions were utilized to demonstrate the effectiveness of the emulsions of the invention. Emulsions A and B were prepared according to the invention by mixing the compositions of the invention with water within an induced shear environment at 140° F. until the emulsions were uniform and consistent. The following Table 5 illustrates the composition of the oil phases of Emulsion A, which contained no t-alkylamine alkaline compound, and Emulsion B, which contained the optional t-alkylamine alkaline compound, prepared according to the present invention.

TABLE 5

| Component | Emulsion A weight % | Emulsion B weight % |
|---|---|---|
| alkyl alkylphosphonate ester (Sylfat ® K - Arizona Chemical, Panama City, Florida) | 3 | 3 |
| trimer acid ester (Priolube ® 3952 - Uniqema, Wilmington, Delaware) | 13.8 | 13.8 |
| pentaerythritol tetraoleate polyol ester* | 10 | 10 |
| ethoxylated tallowamine and sodium petroleum sulfate emulsifiers* | 3.03 | 4.03 |
| $C_{12}$ to $C_{14}$ t-alkylamine (Rohm & Haas) | 0 | 2 |
| aminomethylpropanol (Angus-Dow, Buffalo Grove, Illinois) | 0.58 | 0.12 |
| butylated hydroxytoluene* | 0.4 | 0.4 |
| tolyltriazole* | 0.3 | 0.3 |
| hydrocarbon oil* | 68.89 | 66.35 |

*available from a variety of commercial sources

The compositions set forth in Table 5 were then mixed with sufficient water to form emulsions having about 92% to about 95% by weight water.

Emulsions A and B were then inoculated with $10^6$ colony forming units per milliliter (CFU/mL) of a generic bacterial culture containing as the primary components *Pseudomonas cepacia, Pseudomonas aeruginosa, Pseudomonas fluorescens*, and *Clavibacter michiganense*. The emulsions were monitored for bacterial growth and sustenance. The inoculated emulsion samples were maintained at 27° C. with mild aeration. Samples were obtained at periodic intervals and cultured in nutrient agar for 2 days at 37° C. to determine bacterial growth populations.

FIG. 1 illustrates that Emulsion B (■), which contains the $C_{12}$ to $C_{14}$ t-alkylamine alkaline compound, is characterized by greater biostability than Emulsion A, both prepared according to the present invention.

All publications cited in this specification are incorporated herein by reference.

What is claimed is:

1. A metal deformation composition, comprising:

(i) about 0.5% to about 12% by weight of a phosphonate ester;

(ii) about 4% to about 50% by weight of a lubricating ester;

(iii) about 0.5% to about 15% by weight of an emulsifier, dispersant, or combination thereof;

(iv) about 0.1% to about 1% by weight of an antioxidant; and (v) about 0.1% to about 5% by weight of a corrosion inhibitor.

2. The composition according to claim 1, which is substantially free of fatty acids.

3. The composition according to claim 2, further comprising at least 1% by weight fatty acids.

4. The composition according to claim 1, further comprising at least 50% by weight of a solubilizing carrier.

5. The composition according to claim 1, wherein said phosphonate ester is an alkyl alkylphosphonate of the formula:

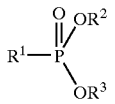

wherein:

$R^1$ is $C_2$ to $C_{20}$ alkyl, substituted $C_2$ to $C_{20}$ alkyl, $C_2$ to $C_{20}$ alkenyl, substituted $C_2$ to $C_{20}$ alkenyl, $C_2$ to $C_{20}$ alkynyl, substituted $C_2$ to $C_{20}$ alkynyl, $C_6$ to $C_{20}$ aryl, and $C_6$ to $C_{20}$ alkyl aryl;

$R^2$ and $R^3$ are independently H, $C_1$ to $C_8$ alkyl, substituted $C_1$ to $C_8$ alkyl, $C_2$ to $C_8$ alkenyl, substituted $C_2$ to $C_8$ alkenyl, $C_2$ to $C_8$ alkynyl, substituted $C_2$ to $C_8$ alkynyl, $C_6$ to $C_{20}$ aryl, or $C_6$ to $C_{20}$ alkyl aryl.

6. The composition according to claim 5, wherein $R^1$ is $C_{14}$ to $C_{18}$ alkyl.

7. The composition according to claim 5, wherein $R^2$ is H or $C_1$ to $C_4$ alkyl.

8. The composition according to claim 5, wherein $R^3$ is H or $C_1$ to $C_4$ alkyl.

9. The composition according to claim 5, wherein $R^2$ and $R^3$ are the same.

10. The composition according to claim 9, wherein $R^2$ and $R^3$ are H, methyl, ethyl, or butyl groups.

11. The composition according to claim 1, comprising about 2% to about 6% by weight of said phosphonate ester.

12. The composition according to claim 11, comprising about 3% by weight of said phosphonate ester.

13. The composition according to claim 1, comprising about 24% by weight of said lubricating ester.

14. The composition according to claim 1, wherein said lubricating ester is selected from the group consisting of:

(a) a polyol ester of a $C_7$ to $C_{20}$ fatty acid;

(b) a trimer or dimer acid ester of a methoxy polyethylene glycol monohydric alcohol having an average molecular weight of about 350;

(c) a trimer or dimer acid ester of a methoxy polyethylene glycol monohydric alcohol having an average molecular weight of about 350 and a $C_1$ to $C_9$ aliphatic monohydric alcohol;

(d) a trimer or dimer acid ester of a $C_1$ to $C_9$ aliphatic monohydric alcohol; and (e) combinations of (a), (b), (c), and (d).

15. The composition according to claim 14, wherein said polyol ester is the product resulting from the reaction of a $C_7$ to $C_{20}$ fatty acid with pentaerythritol, trimethylolpropane, trimethyolethane, neopentylglycol, or neopentylglycol monohydroxy pivalate.

16. The composition according to claim 14, wherein said trimer ester is formed from the esterification of a polymerized unsaturated $C_{12}$ to $C_{24}$ fatty acid with a monohydric alkoxylated alcohol selected from the group consisting of a $C_{12}$ to $C_{24}$ aliphatic saturated alcohol alkoxylated with about 2 to about 25 moles of a $C_2$ to $C_5$ alkylene oxide, a $C_1$ to $C_4$ terminated alkoxy polyalkylene glycol alkoxylated with about 2 to about 25 moles of a $C_2$ to $C_5$ alkylene oxide, and combinations thereof.

17. The composition according to claim 14, wherein said trimer ester is formed from the esterification of a polymerized unsaturated $C_{12}$ to $C_{24}$ fatty acid with a monohydric alkoxylated alcohol selected from the group consisting of a $C_1$ to $C_{24}$ aliphatic saturated alcohol alkoxylated with about 2 to about 25 moles of a $C_2$ to $C_5$ alkylene oxide, a $C_1$ to $C_4$ terminated alkoxy polyalkylene glycol alkoxylated with about 2 to about 25 moles of a $C_2$ to $C_5$ alkylene oxide, and combinations thereof; and an aliphatic $C_1$ to $C_{24}$ monohydric alcohol.

18. The composition according to claim 1, comprising about 0.5 to about 6% by weight of said emulsifier, dispersant, or combination thereof.

19. The composition according to claim 1, wherein said emulsifier or dispersant is selected from the group consisting of alkoxylated linear alcohols, alkoxylated secondary alcohols, alkoxylated alkylaryl alcohols, alkoxylated primary amines, alkoxylated amides, alkoxylated phosphate esters, alkoxylated acids, sodium petroleum sulfonates, and combinations thereof.

20. The composition according to claim 1, comprising about 0.4% by weight of said antioxidant.

21. The composition according to claim 1, wherein said antioxidant is selected from the group consisting of butylated hydroxytoluene, butylated hydroxyanisole, alkylated diphenylamine, and phosphites.

22. The composition according to claim 1, comprising about 1% by weight of said corrosion inhibitor.

23. The composition according to claim 1, wherein said corrosion inhibitor is selected from the group consisting of benzotriazole, tolyltriazole, and petroleum sulfonates.

24. The composition according to claim 1, wherein said carrier has a viscosity greater than or equal to about 50 to about 3000 Saybolt Universal Seconds at 100° F.

25. The composition according to claim 24, wherein said carrier is a hydrocarbon oil.

26. The composition according to claim 25, wherein said hydrocarbon oil is selected from the group consisting of mineral oils, naphthenic hydrocarbon oils, paraffinic hydrocarbon oils, poly α-olefins, alkylbenzenes, polyisobutylenes, and polypropylenes.

27. The composition according to claim 24, wherein said carrier is an ester or lubricating ester.

28. The composition according to claim 1, further comprising an alkaline compound.

29. The composition according to claim 28, comprising about 0.1% to about 5% by weight of said alkaline compound.

30. The composition according to claim 28, wherein said alkaline compound is selected from the group consisting of alkanolamines, alkali hydroxides, alkylamines, N-alkylalkanol amines, and combinations thereof.

31. The composition according to claim 30, wherein said alkanolamine is selected from the group consisting of monoethanolamine, triethanolamine, aminomethyl propanol, monoisopropanol amine, triisopropanolamine, and diglycolamine.

32. The composition according to claim 30, wherein said alkali hydroxide is sodium hydroxide or potassium hydroxide.

33. A metal deformation composition which is substantially free of fatty acids, comprising:

(i) about 0.5% to about 12% by weight of a phosphonate ester;

(ii) about 4% to about 50% by weight of a lubricating ester;

(iii) about 0.5% to about 15% by weight of an emulsifier, dispersant, or combination thereof;

(iv) about 0.1% to about 1% by weight of an antioxidant; and (v) about 0.1% to about 5% by weight of a corrosion inhibitor.

34. A metal deformation composition, comprising:

(i) about 1% to about 10% by weight of a phosphonate ester;

(ii) about 4% to about 50% by weight of a lubricating ester;

(iii) about 1% to about 15% by weight of an emulsifier, dispersant, or combination thereof;

(iv) about 0.1% to about 5% by weight of an alkaline compound; and (v) about 50% to about 85% by weight of a solubilizing carrier.

35. A metal deformation composition, comprising:

(i) about 0.5% to about 12% by weight of a phosphonate ester;

(ii) about 4% to about 50% by weight of a lubricating ester;

(iii) about 0.5% to about 15% by weight of an emulsifier, dispersant, or combination thereof;

(iv) about 0.1% to about 1% by weight of an antioxidant;

(v) about 0.1% to about 5% by weight of a corrosion inhibitor; and (vi) at least 50% by weight of a solubilizing carrier.

36. A metal deformation composition, comprising:

(i) about 1% to about 10% by weight of a phosphonate ester;

(ii) about 4% to about 25% by weight of a trimer acid ester of a methoxypolyethylene glycol monohydric alcohol having an average molecular weight of about 350, a $C_1$ to $C_9$ aliphatic monohydric alcohol, or combinations thereof;

(iii) about 1% to about 15% by weight of an emulsifier, dispersant, or combination thereof;

(iv) about 0.1% to about 5% by weight of an alkaline compound;

(v) about 0.1% to about 1% by weight of an antioxidant;

(vi) about 0.1% to about 5% by weight of a corrosion inhibitor; and (vii) about 50% to about 85% by weight of a hydrocarbon oil.

37. A metal deformation composition, comprising:

(i) about 1% to about 10% by weight of a phosphonate ester;

(ii) about 4% to about 25% by weight of a trimer acid ester of a methoxypolyethylene glycol monohydric alcohol having an average molecular weight of about 350, a $C_1$ to $C_9$ aliphatic monohydric alcohol, or combinations thereof;

(iii) about 1% to about 15% by weight of an emulsifier, dispersant, or combination thereof;

(iv) about 4% to about 20% by weight of a polyol ester of a $C_7$ to $C_{20}$ fatty acid;

(v) about 0.1% to about 1% by weight of an antioxidant;

(vi) about 0.1% to about 5% by weight of a corrosion inhibitor;

(vii) about 0.1% to about 5% by weight of an alkaline compound; and (viii) about 50% to about 85% by weight of a hydrocarbon oil.

38. An oil-in-water emulsion comprising:

(a) about 1% to about 20% by weight of an oil phase, comprising:

(i) about 0.5% to about 12% by weight of a phosphonate ester; and (ii) at least 50% by weight of a solubilizing carrier; and (b) about 80% to about 99% by weight water.

39. The emulsion according to claim 38, which is substantially free of fatty acids.

40. The emulsion according to claim 39, further comprising at least 1% by weight fatty acids.

41. The emulsion according to claim 38, comprising about 2% to about 10% by weight of said oil phase.

42. The emulsion according to claim 41, comprising about 4% to about 8% by weight of said oil phase.

43. The emulsion according to claim 38, wherein said carrier has a viscosity greater than or equal to about 50 to about 3000 Saybolt Universal Seconds at 100° F.

44. The emulsion according to claim 43, wherein said carrier is a hydrocarbon oil.

45. The emulsion according to claim 44, wherein said hydrocarbon oil is selected from the group consisting of mineral oils, naphthenic hydrocarbon oils, paraffinic hydrocarbon oils, poly α-olefins, alkylbenzenes, polyisobutylenes, and polypropylenes.

46. The emulsion according to claim 38, wherein said carrier is an ester or lubricating ester.

47. The emulsion according to claim 38, wherein said phosphonate ester is an alkyl alkylphosphonate of the formula:

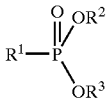

wherein:

$R^1$ is a $C_2$ to $C_{20}$ alkyl, substituted $C_2$ to $C_{20}$ alkyl, $C_2$ to $C_{20}$ alkenyl, substituted $C_2$ to $C_{20}$ alkenyl, $C_2$ to $C_{20}$ alkynyl, substituted $C_2$ to $C_{20}$ alkynyl, $C_6$ to $C_{20}$ aryl, and $C_6$ to $C_{20}$ alkyl aryl;

$R^2$ and $R^3$ are independently H, $C_1$ to $C_8$ alkyl, substituted $C_1$ to $C_8$ alkyl, $C_2$ to $C_8$ alkenyl, substituted $C_2$ to $C_8$ alkenyl, $C_2$ to $C_8$ alkynyl, substituted $C_2$ to $C_8$ alkynyl, $C_6$ to $C_{20}$ aryl, and $C_6$ to $C_{20}$ alkyl aryl.

48. The emulsion according to claim 47, wherein $R^1$ is $C_{14}$ to $C_{18}$ alkyl.

49. The emulsion according to claim 47, wherein $R^2$ is H or $C_1$ to $C_4$ alkyl.

50. The emulsion according to claim 47, wherein $R^3$ is H or $C_1$ to $C_4$ alkyl.

51. The emulsion according to claim 47, wherein $R^2$ and $R^3$ are the same.

52. The emulsion according to claim 51, wherein said $R^2$ and $R^3$ are H, methyl, ethyl, or butyl groups.

53. The emulsion according to claim 38, comprising about 2% to about 6% by weight of said phosphonate ester.

54. The emulsion according to claim 53, comprising about 3% by weight of said phosphonate ester.

55. The emulsion according to claim 38, further comprising a lubricating ester.

56. The emulsion according to claim 55, comprising about 4% to about 80% by weight of said lubricating ester.

57. The emulsion according to claim 56, comprising about 24% by weight of said lubricating ester.

58. The emulsion according to claim 55, wherein said lubricating ester is selected from the group consisting of:

(a) a polyol ester of a $C_7$ to $C_{20}$ fatty acid;

(b) a trimer or dimer acid ester of a methoxy polyethylene glycol monohydric alcohol having an average molecular weight of about 350;

(c) a trimer or dimer acid ester of a methoxy polyethylene glycol monohydric alcohol having an average molecular weight of about 350 and a $C_1$ to $C_9$ aliphatic monohydric alcohol; and (d) a trimer or dimer acid ester of a $C_1$ to $C_9$ aliphatic monohydric alcohol; and (e) combinations of (a), (b), (c), and (d).

59. The emulsion according to claim 58, wherein said polyol ester is the product resulting from the reaction of a $C_7$ to $C_{20}$ fatty acid ester with pentaerythritol, trimethylolpropane, trimethyolethane, neopentylglycol, or neopentylglycol monohydroxypivalate.

60. The emulsion according to claim 58, wherein said trimer ester is formed from the esterification of a polymerized unsaturated $C_{12}$ to $C_{24}$ fatty acid with a monohydric alkoxylated alcohol selected from the group consisting of a $C_1$ to $C_{24}$ aliphatic saturated alcohol alkoxylated with about 2 to about 25 moles of a $C_2$ to $C_5$ alkylene oxide, a $C_1$ to $C_4$ terminated alkoxy polyalkylene glycol alkoxylated with about 2 to about 25 moles of a $C_2$ to $C_5$ alkylene oxide, and combinations thereof.

61. The emulsion according to claim 58, wherein said trimer ester is formed from the esterification of a polymerized unsaturated $C_{12}$ to $C_{24}$ fatty acid with a monohydric alkoxylated alcohol selected from the group consisting of a $C_1$ to $C_{24}$ aliphatic saturated alcohol alkoxylated with about 2 to about 25 moles of a $C_2$ to $C_5$ alkylene oxide, a $C_1$ to $C_4$ terminated alkoxy polyalkylene glycol alkoxylated with about 2 to about 25 moles of a $C_2$ to $C_5$ alkylene oxide, and combinations thereof, and an aliphatic $C_1$ to $C_{24}$ monohydric alcohol.

62. The emulsion according to claim 38, further comprising an emulsifier, dispersant, or combination thereof.

63. The emulsion according to claim 62, comprising about 0.5% to about 15% by weight of said emulsifier, dispersant, or combination thereof.

64. The emulsion according to claim 63, comprising about 1% by weight of said emulsifier, dispersant, or combination thereof.

65. The emulsion according to claim 62, wherein said emulsifier or dispersant is selected from the group consisting of alkoxylated linear alcohols, alkoxylated secondary alcohols, alkoxylated alkylaryl alcohols, alkoxylated primary amines, alkoxylated amides, alkoxylated phosphate esters, alkoxylated acids, sodium petroleum sulfonates, and combinations thereof.

66. The emulsion according to claim 38, further comprising an antioxidant.

67. The emulsion according to claim 66, comprising about 0.1% to about 1% by weight of said antioxidant.

68. The emulsion according to claim 67, comprising about 0.4% by weight of said antioxidant.

69. The emulsion according to claim 66, wherein said antioxidant is selected from the group consisting of butylated hydroxytoluene, butylated hydroxyanisole, alkylated diphenylamine, and phosphites.

70. The emulsion according to claim 38, further comprising a corrosion inhibitor.

71. The emulsion according to claim 70, comprising about 0.1% to about 1% by weight of a corrosion inhibitor.

72. The emulsion according to claim 70, wherein said corrosion inhibitor is selected from the group consisting of benzotriazole, tolyltriazole, and petroleum sulfonates.

73. The emulsion according to claim 38, further comprising an alkaline compound.

74. The emulsion according to claim 73, comprising about 0.1% to about 5% by weight of said alkaline compound.

75. The emulsion according to claim 73, wherein said alkaline compound is selected from the group consisting of alkanolamines, alkali hydroxides, alkylamines, N-alkylalkanol amines, and combinations thereof.

76. The emulsion according to claim 75, wherein said alkanolamine is selected from the group consisting of monoethanolamine, triethanolamine, aminomethylpropanol, monoisopropylamine, triisopropylamine, and diglycolamine.

77. The emulsion according to claim 75, wherein said alkali hydroxide is sodium hydroxide or potassium hydroxide.

78. An oil-in-water emulsion comprising:

(a) about 1% to about 20% by weight of an oil phase, comprising:

(i) about 1% to about 10% by weight of a phosphonate ester;

(ii) about 1% to about 15% by weight of an emulsifier, dispersant, or combination thereof;

(iii) about 4% to about 50% by weight of a lubricating ester;

(iv) about 50% to about 85% by weight of a carrier; and (v) about 0.1% to about 5% by weight of an alkaline compound;

(b) about 80% to about 99% by weight water.

79. An oil-in-water emulsion comprising:

(a) about 1% to about 20% by weight of an oil phase, comprising:

(i) about 1 to about 10% by weight of a phosphonate ester;

(ii) about 4 to about 25% by weight of a trimer acid ester of a methoxypolyethylene glycol monohydric alcohol having an average molecular weight of about 350, a $C_1$ to $C_9$ aliphatic monohydric alcohol, or combinations thereof;

(iii) about 1% to about 15% by weight of an emulsifier, dispersant, or combination thereof;

(iv) about 0.1% to about 1% by weight of an antioxidant;

(v) about 0.1% to about 5% by weight of a corrosion inhibitor;

(vi) about 50% to about 85% by weight of a hydrocarbon oil; and (vii) about 0.1% to about 5% by weight of an alkaline compound;

(b) about 80% to about 99% by weight water.

80. An oil-in-water emulsion comprising:

(a) about 1% to about 20% by weight of an oil phase, comprising:

(i) about 1% to about 10% by weight of a phosphonate ester;

(ii) about 4% to about 25% by weight of a trimer acid ester of a methoxypolyethylene glycol monohydric alcohol having an average molecular weight of about 350, a $C_1$ to $C_9$ aliphatic monohydric alcohol, or combinations thereof;

(iii) about 4% to about 20% by weight of a polyol ester of a $C_7$ to $C_{20}$ fatty acid;

(iv) about 1% to about 15% by weight of an emulsifier, dispersant, or combination thereof;

(v) about 0.1% to about 5% by weight of a corrosion inhibitor;

(vi) about 0.1% to about 1% by weight of an antioxidant;

(vii) about 50% to about 85% by weight of a hydrocarbon oil; and (viii) about 0.1% to about 5% by weight of an alkaline compound;

(b) about 80% to about 99% by weight water.

81. A method of deforming a metal comprising the steps of applying to said metal the composition of claim 1 and deforming said metal.

82. The method according to claim 81, wherein said metal is aluminum, iron, copper, magnesium, tin, zinc, or alloys thereof.

83. The method according to claim 81, wherein deforming said metal comprises rolling, drawing, or forming said metal.

84. A method of deforming a metal comprising the steps of applying to said metal the composition of claim 2 and deforming said metal.

85. The method according to claim 84, wherein said metal is aluminum, iron, copper, magnesium, tin, zinc, or alloys thereof.

86. The method according to claim 84, wherein deforming said metal comprises rolling, drawing, or forming said metal.

87. A method of deforming a metal comprising the steps of applying to said metal the composition of claim 3 and deforming said metal.

88. The method according to claim 87, wherein said metal is aluminum, iron, copper, magnesium, tin, zinc, or alloys thereof.

89. The method according to claim 87, wherein deforming said metal comprises rolling, drawing, or forming said metal.

90. A method of deforming a metal comprising the steps of applying to said metal the emulsion of claim 38 and deforming said metal.

91. The method according to claim 90, wherein said metal is aluminum, iron, copper, magnesium, tin, zinc, or alloys thereof.

92. The method according to claim 90, wherein deforming said metal comprises rolling, drawing, or forming said metal.

93. A method of deforming a metal comprising the steps of applying to said metal the emulsion of claim 39 and deforming said metal.

94. The method according to claim 93, wherein said metal is aluminum, iron, copper, magnesium, tin, zinc, or alloys thereof.

95. The method according to claim 93, wherein deforming said metal comprises rolling, drawing, or forming said metal.

96. A method of preparing a composition for use in metal deformation, comprising diluting the composition of claim 1 or 2 with water.

* * * * *